United States Patent [19]

Reist

[11] Patent Number: 4,534,550

[45] Date of Patent: Aug. 13, 1985

[54] APPARATUS FOR PULLING APART FLAT PRODUCTS, ESPECIALLY PRINTED PRODUCTS ARRIVING IN AN IMBRICATED PRODUCT STREAM

[75] Inventor: Walter Reist, Hinwil, Switzerland

[73] Assignee: Ferag AG, Hinwil, Switzerland

[21] Appl. No.: 415,361

[22] Filed: Sep. 7, 1982

[30] Foreign Application Priority Data

Sep. 18, 1981 [CH] Switzerland ..... 6048/81

[51] Int. Cl.[3] ..... B65H 29/68

[52] U.S. Cl. ..... 271/183; 271/197; 271/231; 271/270; 271/272

[58] Field of Search ..... 271/231, 237, 270, 272–274, 271/151, 183, 197, 202, 182

[56] References Cited

U.S. PATENT DOCUMENTS 2,919,789 1/1960 Coakley ..... 271/183 X

FOREIGN PATENT DOCUMENTS 709606 3/1934 Fed. Rep. of Germany .
1179453 10/1964 Fed. Rep. of Germany ..... 271/202
2330614 1/1975 Fed. Rep. of Germany .
2917250 10/1980 Fed. Rep. of Germany ..... 271/202
363666 8/1962 Switzerland .
2061235 5/1981 United Kingdom .

*Primary Examiner*—Richard A. Schacher
*Attorney, Agent, or Firm*—Werner W. Kleeman

[57] ABSTRACT

By means of a first band or belt conveyor an imbricated product stream or formation, formed by product packs, each composed of two overlying printed products, is inputted to a second band or belt conveyor. The conveying velocity of the second band conveyor is twice as large as the conveying velocity of the first band conveyor. Above the second band conveyor there is arranged a retarding or delay device containing an endless transport band. This endless transport band possesses a conveying velocity which is half as large as the conveying velocity of the second band conveyor. The transport band is perforated and travels over a negative pressure chamber operatively connected with a vacuum pump. During movement of a product pack past the negative pressure chamber the uppermost situated product of such pack is seized at its freely exposed region by the transport band and retained thereat by means of the prevailing negative pressure. The seized or engaged printed product is moved by the transport band with a velocity which is half as great as the velocity of movement of the product situated therebelow. In this manner it is possible to pull apart or separate the overlying printed products.

9 Claims, 6 Drawing Figures

APPARATUS FOR PULLING APART FLAT PRODUCTS, ESPECIALLY PRINTED PRODUCTS ARRIVING IN AN IMBRICATED PRODUCT STREAM

BACKGROUND OF THE INVENTION

The present invention relates to a new and improved construction of apparatus for the pulling apart or separation of substantially flat products, especially printed products, arriving in an imbricated product stream or formation.

Generally speaking, the separation apparatus of the present development is of the type comprising an infeed device for the products and a conveyor device arranged after such infeed device. The conveying velocity of the conveyor device is greater than that of the infeed device.

Such type of apparatus is known to the art from German Patent Publication No. 2,822,060, and the corresponding U.S. Pat. No. 4,201,286, granted May 6, 1980. With this prior art equipment the conveyor device is constituted by an endless conveyor element which is equipped with entrainment members arranged at a uniform spacing from one another. These entrainment members, the spacing of which is greater than the mutual spacing of the products in the inbound or arriving imbricated product stream (the so-called imbricated spacing), engage the trailing edges of the products. The entrainment members thus pull apart the products within the imbricated product stream or formation, and thus, make the imbricated spacing uniform. With this equipment the pulling apart of the products only is accomplished by an amount necessary for obtaining such uniformity of the imbricated spacing. The equipment therefore is not provided for the purpose of increasing the spacing between the products by an appreciable amount, i.e. for instance to double such spacing. In order to ensure for a positive seizing of each arriving product by an entrainment member the infeed device and the endless conveyor element must be synchronized with one another which, in turn, requires a corresponding expenditure in equipment.

As is known from the European Patent Publication No. 0 013 920 and the corresponding U.S. Pat. No. 4,333,559, granted June 8, 1982, printed products are frequently transported in packs or packages, so-called product sets, each containing two products. However, if the products are to be individually processed following their transport, then it is necessary to again separate the overlying products in each pack or set to such an extent that the products can be individually manipulated. The previously described state-of-the-art equipment is, however, not suitable for this purpose.

SUMMARY OF THE INVENTION

Therefore, with the foregoing in mind it is a primary object of the present invention to provide a new and improved apparatus for pulling apart or separating substantially flat products, especially printed products, arriving in an imbricated product formation in a highly reliable and efficient manner and with a minimum of equipment expenditure.

Another and more specific object of the present invention is directed to a product separation apparatus of the previously mentioned type, wherein with very simple means there can be reliably carried out pulling apart or separation of the products by an appreciable amount, and wherein, additionally, it is possible to reform an inbound or arriving imbricated product stream, which is formed by packs or sets of overlying products, into a formation where the printed products lie individually over one another in the manner of the tiles of a roof, in other words the individual products of the packs are placed in an imbricated array.

Still a further significant object of the present invention is directed to a new and improved construction of apparatus for pulling apart or separating substantially flat products, especially printed products, arriving in an imbricated product formation, which apparatus is relatively simple in construction and design, extremely economical to manufacture, highly reliable in operation, not readily subject to breakdown or malfunction, and requires a minimum of maintenance and servicing.

Now in order to implement these and still further objects of the invention, which will become more readily apparent as the description proceeds, the product separation apparatus of the present development is manifested by the features that at the region of the conveyor device and at that side of the products where the leading edge of the products is freely exposed or bared, there is arranged a retarding or delay device which acts upon the products moving therepast. This retarding or delay device inhibits the forward movement of the products acted upon by such retarding device for such length of time until a subsequent or upstream located product arrives at the effective region of the retarding or delay device.

By virtue of the fact that the retarding or delay device is arranged at that side of the imbricated product formation where the products are freely exposed or accessible at the region of their leading edge, it is possible for the retarding or delay device to faultlessly act upon the products without any difficulties. Moreover, it is possible to cause the release of the products acted upon by the retarding device by a subsequent product, so that there can be dispensed with the need for any complicated control. Also, there is no longer absolutely necessary an exact synchronization between the infeed device and the conveyor device.

Since the products which are not or no longer, as the case may be, acted upon by the retarding device, are transported away with a velocity which is greater than the infeed velocity of the products by an amount corresponding to the increase of the imbricated spacing, it is possible for the arriving imbricated product stream, infed by the infeed device, to be further processed without there being formed any dam-up of the products.

It is advantageous to provide a construction wherein the retarding device contains at least one revolvingly driven transport band having the same sense of conveying as the conveyor device. This revolvingly driven transport band has a conveying velocity which is smaller than that of the conveying device and with such driven transport band there can be brought into contact the products by means of their freely exposed region. With this construction it is further advantageous if the transport band is structured, for instance, to be air pervious by providing perforations or holes and is guided over a negative pressure or vacuum chamber. With such solution the products inbounding at the negative pressure chamber serve as slide or gate means which briefly close the negative pressure chamber, and thus, render possible the release of the products previously seized or acted upon by the retarding device.

The inventive apparatus is particularly suitable, although not exclusively, for converting a product formation which is formed by product packs or sets lying upon one another in an imbricated array, each of which packs or sets consists of at least two completely overlapping or squared-up products, into an imbricated stream in which the products mutually individually overlap one another in an imbricated fashion, i.e. in the manner of the tiles of a roof.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
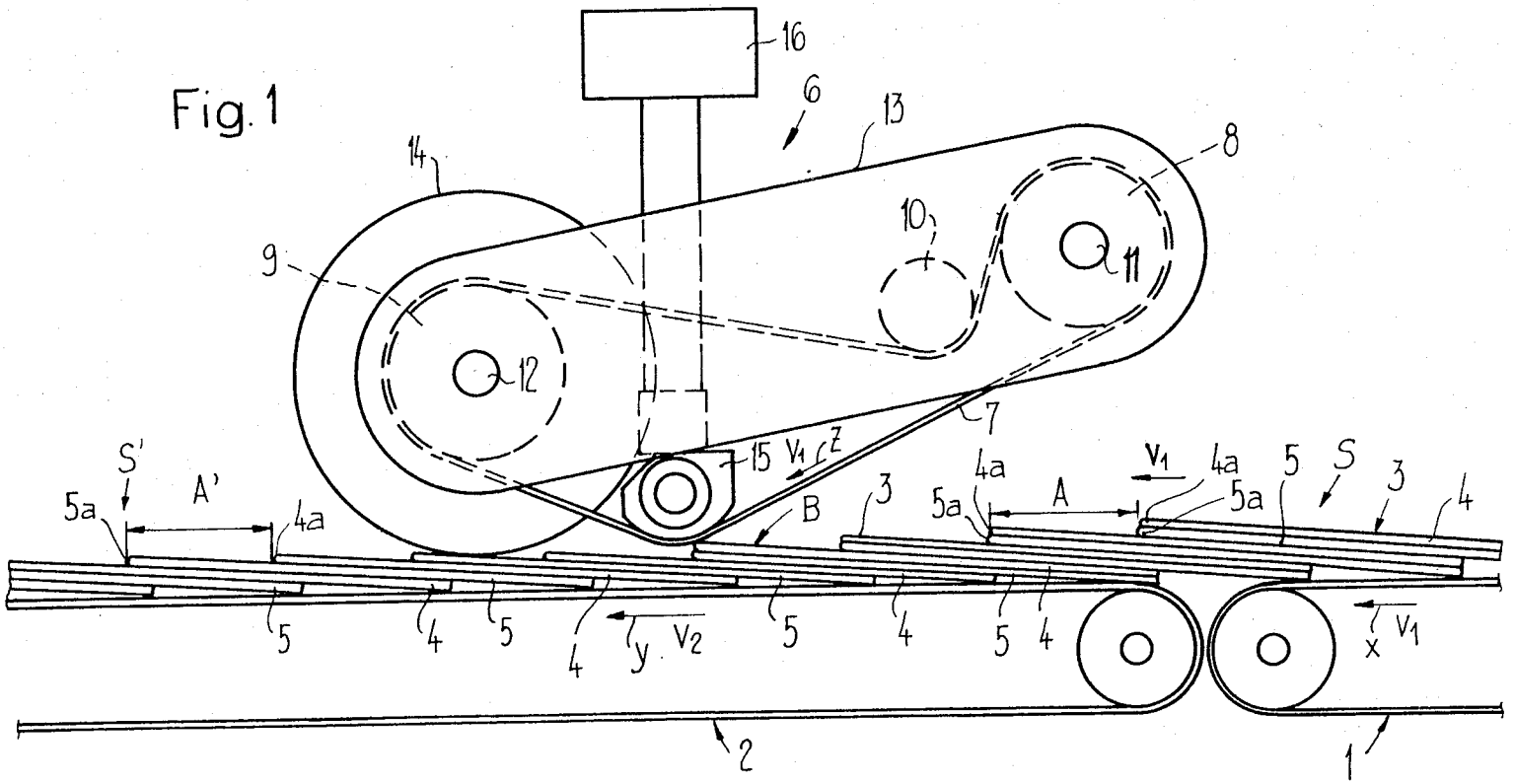
FIG. 1 is a schematic side view of an apparatus for separating or pulling apart printed products which are disposed in the form of imbricated overlying packs or sets, each of which is formed by two completely overlying or fully superimposed printed products.

Describing now the drawings, and turning specifically to FIG. 1 there is shown therein an infeed device 1 constructed as a band or belt conveyor—also referred to in the art as a conveyor belt or band—following which there is arranged a conveyor device 2 which likewise is constructed as a band or belt conveyor. The infeed device 1 is driven in any suitable and therefore not particularly illustrated fashion in the direction of the arrow X at a velocity $V_1$. The other band conveyor forming the conveyor device 2 is likewise driven in not particularly illustrated but appropriate fashion, in the direction of the arrow Y, and specifically, at a velocity $V_2$ which is essentially twice as large as the conveying velocity $V_1$ of the infeed device 1 constituted by its related band conveyor.

By means of the infeed device or band conveyor 1 the conveyor device 2 has inputted thereto an imbricated product stream or formation S which is formed by product packs or sets 3 lying over one another in the manner of the tiles of a roof, in other words in an imbricated pack array. Each pack 3 is formed, for instance, by two essentially completely overlying or superimposed printed products 4 and 5, the respective leading edges 4*a* and 5*a* of which are freely exposed or bared. The spacing of the packs or sets 3 within the imbricated product formation or stream S has been designated by reference character A.

Above the conveyor device 2 there is arranged a retarding or delay device 6 which comprises an endless perforated or otherwise suitably constructed transport band or belt 7 which allows air to pass therethrough. This transport band 7 is trained about guide rolls 8 and 9 and a tensioning roll 10. The guide rolls 8 and 9 are mounted in a rocker or balance member 13 by means of a respective shaft 11 and 12. The rocker or balance member 13 is pivotable about the shaft 11. Additionally, a pair of support rolls 14 are arranged upon the shaft 12, and in the illustration of FIG. 1 only one of the support rolls 14 is visible. The transport band 7 is driven in any appropriate fashion by a suitable drive in the direction of the arrow Z, i.e. with the same conveying sense as the band conveyor 2. The drive velocity of the transport band 7 amounts to $V_1$, and thus, is equal to the conveying velocity $V_1$ of the infeed device 1 and only half as large as the conveying velocity $V_2$ of the band conveyor 2.

Directly neighboring the path of movement of the imbricated product stream S and arranged above the same is a negative pressure chamber or vacuum compartment 15 over which travels the transport band 7 and which is operatively connected with any suitable and therefore here merely schematically illustrated vacuum pump 16 or equivalent vacuum producing facility.

Figure 2:
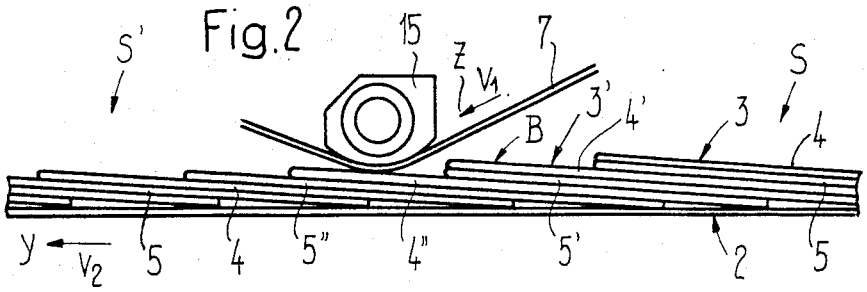
FIGS. 2, 3 and 4 illustrate the product separation apparatus depicted in FIG. 1 at different successive points in time of its operation.
Figure 3:
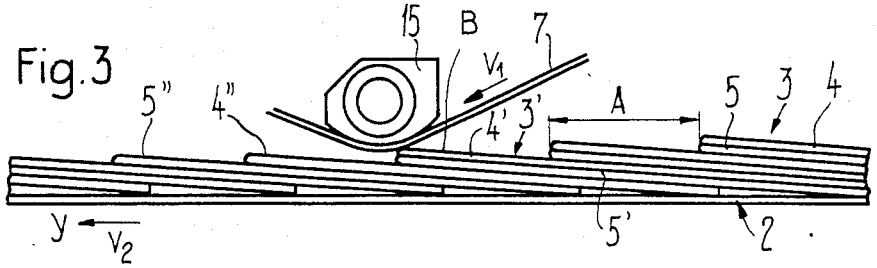
Figure 4:
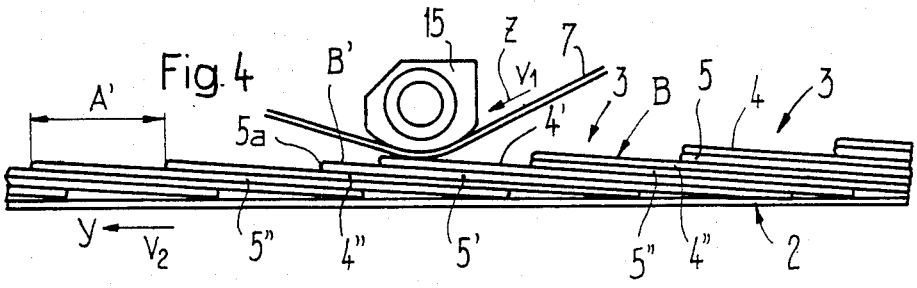

Based upon the illustration of FIGS. 2, 3 and 4 there will be now explained the mode of operation of the product separation or pulling apart apparatus depicted in FIG. 1.

At the point in time shown in FIG. 2 the product 4″ of a product pack or set contacts the transport band or belt 7. Due to the negative pressure or vacuum prevailing in the negative pressure or vacuum chamber 15 and by virtue of the effect of the vacuum upon the perforated transport band 7 this printed product 4″ is retained at the transport band 7, and additionally, raised somewhat away from the printed product 5″ located therebelow. The product 4″ seized by the transport band 7 is moved by such transport band with a velocity $V_1$ whereas the printed product 5″ located therebelow is moved with a velocity $V_2$ in the direction of the arrow Y. The lowest situated printed product 5″ therefore is moved forwardly beneath the printed product 4″ reposing thereon.

The printed product 4″ is moved for such length of time by the action of the transport band 7 until the products 4′ and 5′ of the next product pack or set 3′ arrive at the effective region of the transport band 7 and the negative pressure chamber 15, as such has been illustrated in FIG. 3. This product pair 4′, 5′ now acts in the manner of a slide or gage means which advantageously closes the negative pressure chamber 15, and thus, causes a release of the printed product 4″ which was previously retarded or decelerated in its movement, and which accordingly now is further moved at the velocity $V_2$. Now the upper situated printed product 4′ of the next following product pack or set 3′ comes into contact with the transport band 7 where, as already explained, it is held by the prevailing vacuum or negative pressure, and additionally, is raised somewhat off the printed product 5′ located therebelow. This printed product 5′ is further transported at the conveying velocity $V_2$, whereas the upper printed product 4′ is entrained at the velocity $V_1$ by the transport band or belt 7. In this way the printed product 5′ is pulled forwardly below the printed product 4′ reposing thereon, so that now the product region B′ is freely exposed at its leading edge 5*a*, as best seen by referring to FIG. 4. After the retarding device 6, i.e. behind or downstream of the negative pressure chamber 15, there is thus formed an imbricated product stream S′, wherein also the individual printed products 4 and 5 repose upon one another in the manner of tiles of a roof, i.e. in an imbricated fashion, and which, as will be recalled, in the inbound imbricated product stream S were lying in superimposed fashion within a pack or set 3. Since the conveying velocity $V_2$ of the band conveyor 2 is twice as great as the infeed velocity $V_1$ of the imbricated product stream S as well as the conveying velocity $V_1$ of the transport band 7, the imbricated spacing or distance A' (FIG. 4) in the imbricated product stream S' is approximately equal to the imbricated spacing or distance A in the arriving or inbound imbricated product stream S. By appropriately selecting the ratio between the velocities $V_1$ and $V_2$ it is possible to alter the relationship between the imbricated spacings A and A' in the inbound and outbound imbricated products streams S and S', respectively.

The product separation or pulling apart apparatus depicted in FIG. 1 can also be used in a manner different from that heretofore described. Thus, for instance, with this equipment it is also possible to increase the imbricated spacing in an imbricated product formation where each product only partially overlaps the preceding product. Such use of the equipment depicted to FIG. 1 will be now explained in conjunction with FIGS. 5 and 6.

Figures 5, 6:
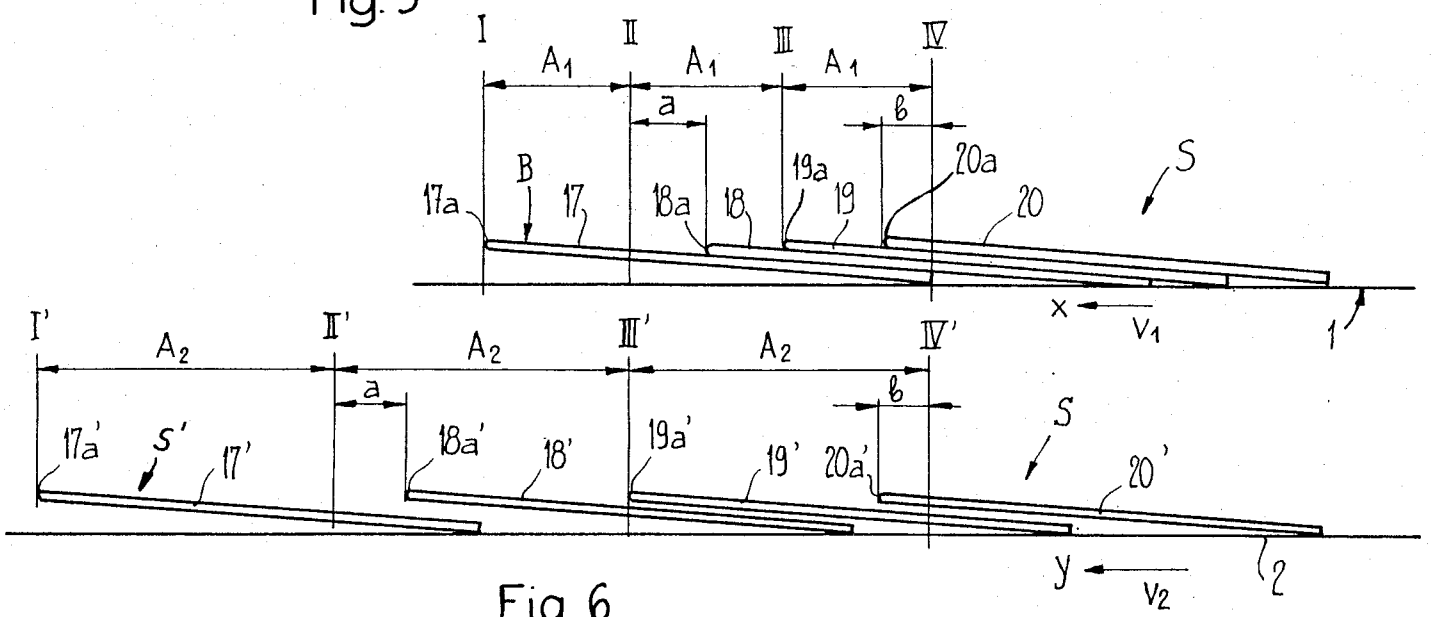
FIGS. 5 and 6 schematically illustrate the workings of the apparatus according to FIG. 1 in terms of increasing the spacing between the products within an imbricated product formation.

If the imbricated product formation or stream S, illustrated in FIG. 5, is infed at a velocity $V_1$ by the infeed device 1 to the conveyor device 2 and is moved by such conveyor device 2 at a velocity $V_2$ past the retarding device 6, then in the manner described previously in conjunction with FIGS. 2 to 4 all of the printed products 17, 18, 19 and 20 will be moved by the transport band 7 at the velocity $V_1$ for such length of time until the next following or trailing product causes a release of the product fixedly retained at the conveyor band or belt 7. If the velocity $V_2$ is twice as large as the velocity $V_1$, then in this manner the imbricated spacing or distance $A_2$ in the outbound imbricated product stream S' (FIG. 6) becomes twice as large as the imbricated spacing or distance $A_1$ in the arriving imbricated product stream S (FIG. 5). By such pulling apart of the printed products 17, 18, 19 and 20 it is possible to render more uniform an imbricated product stream S having an irregular imbricated spacing. This now will be explained more fully hereinafter.

As shown in FIG. 5 the distance or spacing between the leading edges 17*a*, 18*a*, 19*a* and 20*a* of the inbound or arriving printed products 17, 18, 19 and 20, respectively, does not correspond to the set or reference spacing $A_1$. If the imbricated spacing were uniform throughout, then in the illustration of FIG. 5 the leading edges 17*a*, 18*a*, 19*a* and 20*a* would have to be located in the positions which have been indicated by the vertically extending lines referenced by reference characters I, II, III and IV, respectively. However, as illustrated in FIG. 5, the leading edge 18*a* of the printed product 18 is located by the distance a rearwardly of the set or reference position designated by reference character II, whereas the leading edge 20*a* of the printed product 20 is located by the distance or spacing b forwardly of the set or reference position designated by reference character IV.

In FIG. 6 there has now been illustrated, in a showing corresponding to FIG. 5, the imbricated product stream S' after moving past the retarding device 6. The set or reference positions of the leading edges 17*a*', 18*a*', 19*a*' and 20*a*' have been correspondingly designated by reference characters I', II', III' and IV', respectively. Just as was previously the case, here also the leading edge 18*a*' lies by the same amount behind the set or reference position designated by reference character II', whereas the leading edge 20*a*' is located by the same amount b forwardly of the set or reference position designated by reference character IV'. After the pulling apart of the imbricated stream the deviation of the printed products 18' and 20' from their set or reference position therefore is equal in magnitude to that in the arriving or inbound imbricated product stream S. Since, however, the imbricated spacing $A_2$ has been enlarged, i.e. doubled, the percentual deviation of the printed products 18' and 20' from their set or reference position has been correspondingly reduced, i.e. has been halved.

The described apparatus has the advantage that each product automatically ensures for the detachment of the leading product from the transport band 7. A special control for this purpose is therefore not needed.

It should be further understood the described equipment can be also differently constructed from what has been described as concerns a number of parts or components thereof. As to these different possible variant constructions there will be discussed hereinafter several such possibilities.

Although the periodic contact of the printed products 4 at their freely exposed region B at the transport band 7 can be accomplished by means of negative pressure or vacuum in a particularly simple fashion, it is of course also possible to ensure for a brief entrainment of the printed products 4 by the transport band or belt 7 through the use of other suitable means.

Additionally, it is conceivable to construct the entire retarding device 6 differently than described and illustrated. Thus, for instance, there can be provided a retarding or delay element which always holds back the upper printed product 4 of a product pack or set 3 and hinders a further movement in conjunction with the lower printed product 5. The release of the printed products by the retarding element likewise can be accomplished by the next following or trailing printed product pair 3. Furthermore, it is also possible to provide a control for such retarding element.

It is also possible in the described manner to process an imbricated product stream or formation in which, different than the imbricated product formation depicted in FIGS. 1 to 6, each printed product or each product pack bears in an imbricated fashion, i.e. in the manner of tiles of a roof, upon the subsequent or next following product or product pack, as the case may be. However, with such construction of imbricated product stream the retarding device 6 then must be arranged beneath the imbricated product stream or formation, so that it can act upon the region of the leading edge of the printed products.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. An apparatus for pulling apart substantially flat products, especially printed products, arriving in an imbricated product stream, comprising:

an infeed device for the products which move in a predetermined direction of travel;

a conveyor device arranged after said infeed device with respect to the direction of travel of the products;

said conveyor device having a conveying velocity which is greater than the conveying velocity of the infeed device;

a retarding device having an effective region for temporarily acting upon the products moving past said effective region of said retarding device;

said retarding device being arranged at the region of the conveyor device and at that side of the products at which leading edges of the products are freely exposed; and said retarding device retarding the forward movement of the products acted upon by said retarding device for such length of time until a trailing product arrives at said effective region of the retarding device.

2. The apparatus as defined in claim 1, wherein:

said retarding device comprises at least one revolvingly driven transport band having the same conveying sense as said conveyor device;

said revolvingly driven transport band having a conveying velocity which is smaller than the conveying velocity of the conveyor device and with which transport band there can be brought into contact the products at a freely exposed region thereof.

3. The apparatus as defined in claim 2, wherein:

said transport band essentially possesses the same conveying velocity as the conveying velocity of the infeed device.

4. The apparatus as defined in claims 2 or 3, wherein:

said transport band comprises an air pervious transport band; and a negative pressure chamber over which there is guided said transport band.

5. The apparatus as defined in claim 4, wherein:

said air pervious transport band comprises a perforated transport band.

6. The apparatus as defined in claim 2, further including:

rocker means for guiding said transport band;

means for pivotably mounting said rocker means; and said rocker means bearing upon said imbricated product stream.

7. The apparatus as defined in claim 1, wherein:

said retarding device is arranged above said conveyor device.

8. The apparatus as defined in claim 7, wherein:

said conveyor device comprises a band conveyor.

9. The apparatus as defined in claim 1, wherein:

said apparatus serves for pulling apart products which arrive in product packs bearing upon one another in an imbricated formation, each of said product packs containing at least two completely overlying and squared-up products.

* * * * *